US006468376B2

(12) United States Patent
Biskeborn et al.

(10) Patent No.: US 6,468,376 B2
(45) Date of Patent: Oct. 22, 2002

(54) PRECISION BONDING METHOD AND APPARATUS

(75) Inventors: Robert Glenn Biskeborn, Hollister; Annayya P. Deshpande, San Jose; Calvin Shyhjong Lo, Saratoga; Artemio Juan Torres, Milpitas, all of CA (US)

(73) Assignee: International Business Machines Corporation, Armonk, NY (US)

( * ) Notice: Subject to any disclaimer, the term of this patent is extended or adjusted under 35 U.S.C. 154(b) by 106 days.

(21) Appl. No.: 09/754,498

(22) Filed: Jan. 3, 2001

(65) Prior Publication Data

US 2002/0084040 A1 Jul. 4, 2002

(51) Int. Cl.[7] ..... B30B 15/00
(52) U.S. Cl. ..... 156/228; 156/580
(58) Field of Search ..... 156/228, 580, 156/581, 583.1, 583.3; 100/214, 258 R, 258 A, 315

(56) References Cited

U.S. PATENT DOCUMENTS

| | | | | |
|---|---|---|---|---|
| 5,296,993 A | | 3/1994 | Aboaf et al. | 360/126 |
| 5,331,493 A | | 7/1994 | Schwartz | 360/113 |
| 5,394,285 A | | 2/1995 | Dee et al. | 360/121 |
| 5,423,116 A | | 6/1995 | Sundaram | 29/603 |
| 5,541,793 A | | 7/1996 | Schwartz | 360/127 |
| 5,594,608 A | | 1/1997 | Dee | 360/126 |
| 5,972,150 A | * | 10/1999 | Copp | 156/228 |
| 6,240,992 B1 | * | 6/2001 | Musolino | 156/499 |

* cited by examiner

*Primary Examiner*—James Sells
(74) *Attorney, Agent, or Firm*—G. Marlin Knight

(57) ABSTRACT

A precision clamping apparatus is described which is suitable for use with a high temperature curing process. A clamp according to the invention includes a base plate with a supporting surface for a component (which consists of two portions to be bonded together), and at least two alignment stops against which the first and second sides of the component can be pressed. A pressure plate is provided to mate with the base plate to exert uniform clamping force on the component to allow a uniform thickness of cured adhesive to form between internal surfaces of the component. The pressure plate is precisely aligned with the supporting surface in the horizontal plane by guides which allow vertical movement. The pressure plate is made self-aligning with the surface of the component by being urged toward the supporting surface by a resilient structure which is in turn held in position by attachment to the base plate. Adjustable lateral fingers are provided to urge the component against the alignment stops.

20 Claims, 2 Drawing Sheets

PRECISION BONDING METHOD AND APPARATUS

FIELD OF THE INVENTION

The invention relates to methods and apparatus for bonding of two subcomponents requiring precision alignment and clamping during the curing of the adhesive and more particularly to methods and apparatus for bonding subcomponents of magnetic transducers.

BACKGROUND OF THE INVENTION

Magnetic head assemblies for tape storage systems have read and write heads for a plurality of channels which are allocated laterally across the width of the tape. This is a distinction that tape head assemblies have from heads used in disk drives which have one read and one write element. The functional components of the tape heads are fabricated using thin film techniques which create rows of structures with minute dimensions. One of the steps which may be used in the manufacturing process for a tape head assembly is the bonding of a closure piece over the subcomponent on which a plurality of thin film heads have fabricated. The subcomponents must be precisely positioned and then clamped with uniform pressure during the curing process for the adhesive which is typically elevated temperature. A uniform thickness of the cured adhesive is needed to ensure proper operation of the heads and, therefore, the clamping force must be uniform and well controlled during the curing process.

Thus, there is a need for an improvements in precision clamping devices which can meet the requirements of this and other applications.

SUMMARY OF THE INVENTION

A precision clamping apparatus according to the invention will be described which is suitable for use in an elevated temperature curing process for an adhesive. A method of using a clamping apparatus according to the invention will also be described. The clamping apparatus includes a base plate with a supporting surface for the component and at least two alignment stops against which the first and second sides of the component can be pressed. The pressure plate is flexibly aligned with the base plate to exert uniform clamping force on the component to allow uniform thickness of cured adhesive between internal surfaces of the subcomponents. The pressure plate is made self-aligning with the surface of the component by being urged toward the supporting surface by a resilient structure which is in turn held in position by attachment to the base plate. The uniform clamping force is achieved by aligning the pressure plate with the base plate by guides which allow vertical movement and by urging the pressure plate toward the base plate with a resilient structure which is in turn held in position by attachment to the base plate. Adjustable lateral fingers are provided to urge the component against the alignment stops.

DETAILED DESCRIPTION OF THE INVENTION AND THE PREFERRED EMBODIMENTS

Figure 1:
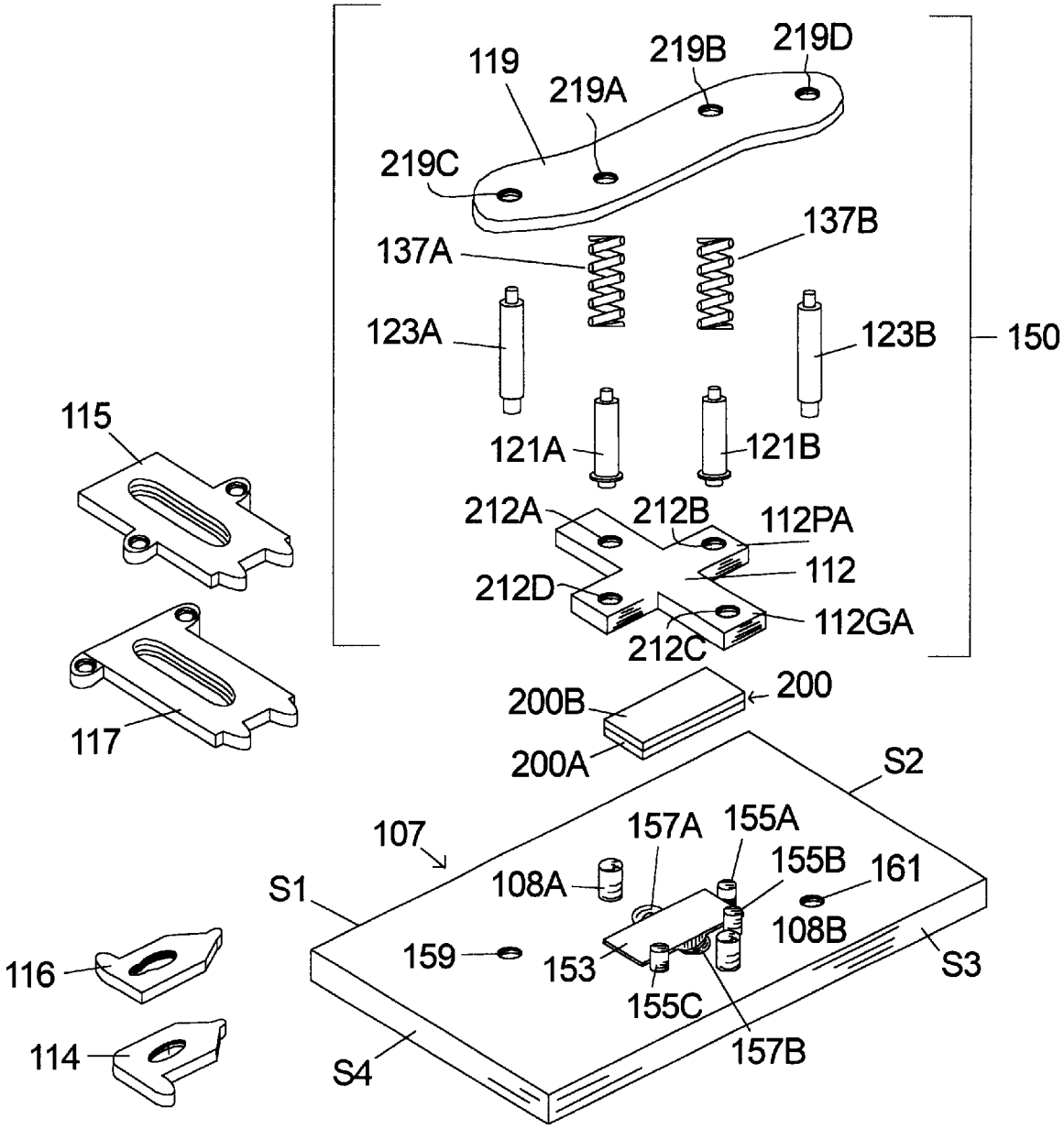
FIG. 1 is an exploded view of a clamp according to the invention.

The structures of a clamp or bonding apparatus according to the invention and their interactions will be described with reference to FIG. 1 which is an exploded view of a clamp 100 according to the invention. The base plate 107 has a planar supporting surface for a component 200 with a planar surface. In the preferred embodiment as shown in FIG. 1, the supporting surface is a raised platform 153 or boss with a planar surface. As shown the raised platform 153 and the base plate 107 are rectangular in a plan view although other shapes may be used. The sides of the base plate 107 will be referred to as S1, S2, S3 and S4 with S1 and S3 being the long sides of the rectangle. The sides of the raised platform 153 are shown parallel to the sides of that raised platform 153 for simplicity although no particular alignment of these sides is required. The raised platform 153 extends above the plane of the top surface of the base plate 107 enough to allow an operator to easily grasp the components. To further aid the grasping operation recessed areas which will be called fingerholes 157A, 157B are provided at two sides (S1 and S3) of the raised platform 153. In this embodiment there are three alignment stops 155A, 155B, 155C which are positioned at two adjacent edges of the raised platform 153. Since the raised platform 153 in this embodiment is rectangular and intended for use with a rectangular component, one alignment stop 155A is positioned on the midline of the short side of the raised platform 153 which faces the S2 side of the base plate 107. The other two alignment stops 155B, 155C are spaced apart along an adjacent long side of the raised platform 153 which faces the S3 side of the base plate 107. The alignment stops 155A, 155B, 155C are implemented as dowels inserted into holes (not shown) formed in the base plate 107. Other shapes and mechanisms can also be used for the stops.

The base plate 107 has pressure plate alignment pins 108A, 108B disposed on the S1 and S3 sides of the raised platform 153. These pressure plate alignment pins 108A, 108B are positioned slightly back from the edges of the raised platform 153 and in this embodiment are separated from the raised platform 153 by the finger-holes 157A, 157B. The pressure plate alignment pins 108A, 108B are preferably dowels which are inserted into holes (not shown) in the base plate 107 and are preferably larger than the alignment pins 155A, 155B, 155C.

In use the clamp 100 will initially have the raised platform 153 exposed so that an operator can place the component 200 on the raised platform 153 in approximately the correct position. The nature and characteristics of the component 200 will be discussed below. After the operator has positioned the component 200 on the raised platform 153, the pressure plate 112 is placed on top of the component 200. The pressure plate 112 is shown as a cross shape with two arms 112PA, 112GA forming right angles. One arm is the guide arm 112GA which is used to engage the pressure plate alignment pins 108A, 108B through holes 212A and 212C to ensure proper positioning in relation to the raised platform 153 while still allowing vertical movement. The two through holes 212A and 212C are located near the opposite ends of the guide arm 112GA which is oriented parallel to the S2 and S4 sides of the base plate 107. The other arm of the pressure plate 112 is the pressure arm 112PA. Shapes other than a cross can also be employed for the pressure plate 112.

Above the pressure plate 112 are compression springs 137A, 137B which loosely fit over shafts 121A, 121B. The lower ends of the shafts 121A, 121B are provided with tips which mate with holes 212B, 212D near the opposite ends of the pressure arm 112PA of the pressure plate 112 which is parallel to the S1 and S3 sides of the base plate 107.

The compression springs 137A, 137B are held in place by the retaining bar 119 which has four hole used as follows.

The two inside holes 219A, 219B allow the ends of shafts 121A, 121B to protrude through to the upper surface of the retaining bar 119. The shafts 121A, 121B are attached to the retaining bar 119 by nuts (not shown), by any other type of fastening devices or methods. The outer holes 219C, 219D of the retaining bar 119 are used to similarly attach the upper ends of risers 123A, 123B. The risers 123A, 123B in this embodiment are cylinders which extend downward from the retaining bar 119 to the base plate 107 which has holes 159, 161 which are sized to be a friction fit for the lower ends of the risers 123A, 123B allowing convenient insertion and removal. Although the friction fit technique is preferred, other means or attaching the risers 123A, 123B to the base plate 107 can easily be substituted.

Figure 2:
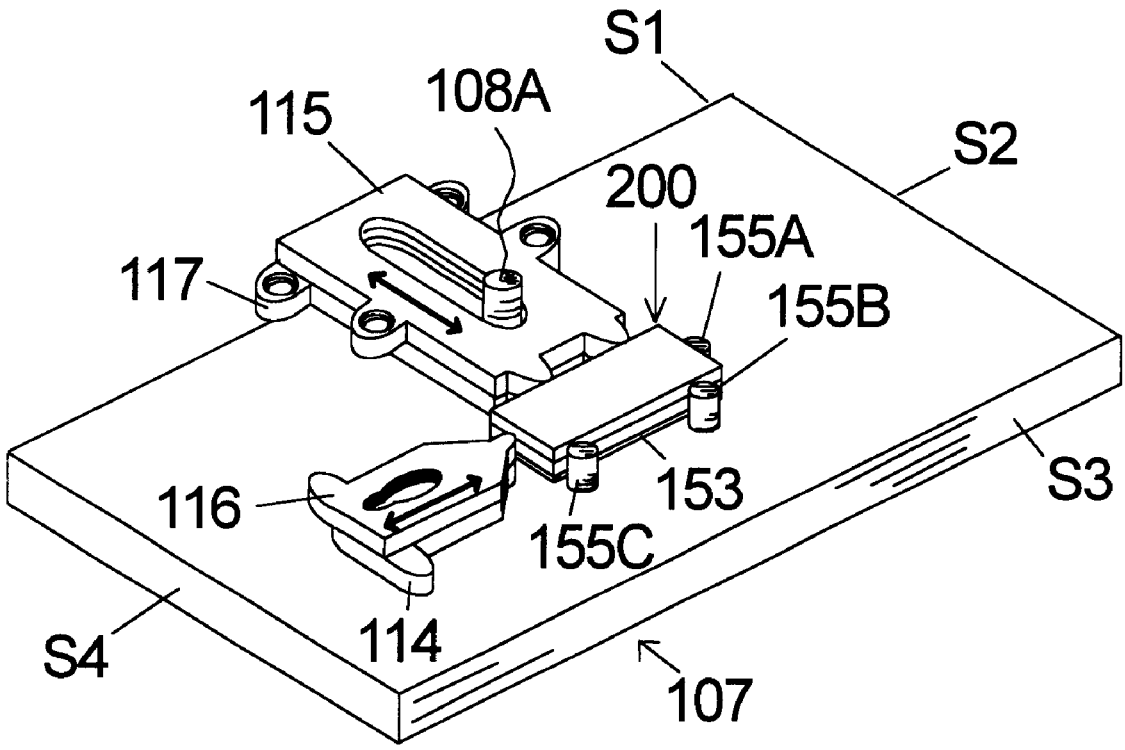
FIG. 2 is an isometric view of only the component of a clamp according to the invention which are used to push the component against the alignment stops.

The preferred embodiment is intended to be used with a component comprising two subcomponents which have an uncured adhesive between them and have some limited range of lateral movement with respect to each other. Therefore, an important feature of the invention is it allows precise lateral alignment of the subcomponents with respect to each other. The mechanisms for urging the component 200 (and it subcomponents) against alignment stops 155A, 155B, 155C will now be described with reference to FIG. 2. FIG. 2 is an isometric view of only the elements of the clamp 100 which are involved in pushing the component 200 laterally in two directions into the alignment stops 155A, 155B, 155C. An area of the base plate 107 extending from the raised platform 153 to the S4 side if the base plate 107 is used to mount two plates which be called the "x-fingers" 114, 116. Although the use of a single element to urge the component against the alignment stops may be adequate for most applications, the preferred embodiment uses two elements for maximum flexibility. The x-fingers 114, 116 narrow down to the small tip which contacts the side of the component 200 and urges it against alignment stop 155A. The x-fingers 114, 116 have a central slot which allows them to be stacked and attached to the base plate 107 by one or more screws, bolts, pins, etc. (not shown). The slots in the x-fingers 114, 116 allow the x-fingers 114, 116 to be moved toward and away from the component 200 independently for maximum flexibility. Once in the desired position the against the component 200, the x-fingers 114, 116 can be firmly attached to the base plate 107 by tightening a retaining device (not shown).

The "y-fingers" 115, 117 are mounted to urge the component 200 into alignment stops 155B, 155C. The y-fingers 115, 117 have two small tips which contacts the side of the component 200 and urges it against alignment stops 155B, 155C. The y-fingers 115, 117 similarly to the x-fingers 114, 116 have a central slot which allows them to be stacked and attached to the base plate 107 and to be moved toward and away from the component 200 independently for maximum flexibility. Once in the desired position the against the component 200, the y-fingers 115, 117 can be firmly attached to the base plate 107 by tightening a retaining device (not shown).

In the particular embodiment shown, the y-fingers 115, 117 must provide clearance for the pressure plate alignment pin 108A. This requirement is met by lengthening the slot to allow the pressure plate alignment pin 108A to extend up through the slot and still allow for the back and forth adjustment of the position of the y-fingers 115, 117.

Since the component for which this embodiment is designed is rectilinear, the two directions (x and y) are perpendicular to each other and act on adjacent sides of the component 200. If the component is not rectilinear, adjustments in the placement and number of the alignment stops and the orientations of the fingers could accommodate a range of other shapes. For example, a cylindrical component could easily be accommodated by minor changes in the positions of the stops and geometry of the fingers.

In the preferred method of using the clamp 100 of the invention the components comprising the pressure plate assembly 150 (shown by the bracket in FIG. 1, which includes the pressure plate 112; shafts 121A, 121B; springs 137A, 137B; retaining bar 119 and risers 123A, 123B) are left assembled. The pressure plate assembly 150 is inserted as a unit into the friction fit holes 159, 161 in the base plate 107 to clamp the component against the supporting surface 153. The x-fingers 114, 116 and the y-fingers 115, 117 are adjusted to urge the sides of the component 200 against alignment stops 155A, 155B, 155C and secured with the appropriate means. The adjustment of the x-fingers 114, 116 and y-fingers 115, 117 can occur before or after the pressure plate assembly 150 is inserted.

The component 200 includes a lower piece 200A which is shown as a rectilinear solid and a mating upper piece 200B which is also shown as a rectilinear solid. In the preferred embodiment and best mode for use of the invention, the lower piece 200A is a substrate with multiple thin film heads for use in a tape drive formed thereon. The manufacturing process for this type of head requires that a closure piece be adhesively bonded to the surface after being precisely aligned with multi-head substrate. The preferred adhesive is one which is thermo-setting. In the process of using clamp 100 it is expected that the upper and lower pieces 200A, 200B will have the adhesive applied and be loosely adhering when placed on the raised platform 153. The clamp 100 must be made from materials which will withstand the temperature stress of the thermal curing. Stainless steel is the preferred material.

The invention has been described as used in a particular embodiment, but the utility of the invention in other embodiments and applications will be readily apparent to those skilled in the art that will nevertheless be within the spirit and scope of the invention.

What is claimed is:

1. A clamping apparatus comprising:

a base plate with a planar supporting surface for a lower surface of a component having lower and upper planar surfaces with the upper planar surface being parallel to the lower planar surface;

at least first and second alignment stops positioned adjacent to the supporting surface and extending above the supporting surface to provide first and second stopping surfaces which are perpendicular to the planar supporting surface;

a pressure plate which contacts the upper planar surface of the component to urge the component against the supporting surface;

one or more guides which engage the pressure plate and the base plate to align the pressure plate with the supporting surface while allowing vertical movement of the pressure plate;

a resilient structure which urges the pressure plate toward the supporting surface, the resilient structure being held in position by attachment to the base plate; and at least first and second alignment fingers which are adjustably attached to the base plate to urge the first and second components against the first and second alignment stops respectively in a first position and release the first and second components in a second position.

2. The clamping apparatus of claim 1, wherein the first alignment finger has a linear movement range along a first axis and the second alignment finger having a linear movement range along a second axis with the first axis being perpendicular to the second axis.

3. The clamping apparatus of claim 2 the first alignment finger further comprising two plates in slidable contact, the two plates having central slots through which a releasable fastening member attaches the two plates to the base plate, the two plates each having a tip which engages the component.

4. The clamping apparatus of claim 1, wherein the base plate further comprises first and second recessed finger slots adjacent to the supporting surface.

5. The clamping apparatus of claim 1, further comprising a retaining member which holds the resilient structure in position, the retaining member being removably attached to the base plate by a friction fit into first and second holes in the base plate.

6. The clamping apparatus of claim 1, wherein the component comprises a substrate with a plurality of tape heads fabricated thereon and a closure piece which have an adhesive between them.

7. The clamping apparatus of claim 1, wherein the first and second alignment fingers are adjustably attached to the base plate to allow movement along an axis toward and away from first and second alignment stops, the first and second alignment fingers being positioned so that the component can be placed on the supporting surface when the first and second alignment fingers are moved away from first and second alignment stops and so that the component will be urged against first and second alignment stops when the first and second alignment fingers are moved toward the first and second alignment stops.

8. The clamping apparatus of claim 7, wherein the first alignment finger further comprises two plates in slidable contact with central slots through which a releasable fastening member attaches the two plates to the base plate, the two plates each having a tip which engages the component.

9. The clamping apparatus of claim 1, further comprising a retaining member which holds the resilient member in position, the retaining member being removably attached to the base plate by first and second risers which have a friction fit into first and second holes in the base plate.

10. The clamping apparatus of claim 1, wherein the pressure plate further comprises first and second arms arranged with a longest dimension of the first arm being perpendicular to a longest dimension of the second arm, the first arm having means for alignment with the base plate and the second arm having means for engaging the resilient member.

11. The clamping apparatus of claim 1, wherein the resilient structure further comprises first and second springs.

12. A bonding apparatus comprising:

a base plate with a planar supporting surface for a lower surface of a component having lower and upper planar surfaces with the upper planar surface being parallel to the lower planar surface;

at least first and second alignment pins positioned adjacent to the supporting surface and extending a first height above the supporting surface to provide first and second stopping surfaces which are perpendicular to the planar supporting surface, the first and second alignment pins being cylindrical and the first and second stopping surfaces being curved;

a pressure plate which contacts the upper planar surface of the component to urge the component against the supporting surface, the pressure plate having first and second features to engage first and second guides;

first and second guides which engage the pressure plate and the base plate to align the pressure plate with the supporting surface in two axes while allowing movement along a third axis;

a resilient structure which urges the pressure plate toward the supporting surface, the resilient structure having first and second springs disposed to exert symmetrical forces on the pressure plate; and a retaining assembly attached to the resilient structure, the retaining assembly having first and second releasable engagement members which bind the retaining assembly to the base plate during use and allow the retaining assembly, the resilient structure and the pressure plate to be removed for loading and unloading.

13. The bonding apparatus of claim 12, wherein the first and second releasable engagement members have a friction fit with mating structures on the base plate.

14. The bonding apparatus of claim 12 further comprising at least a first alignment finger which is adjustably attached to the base plate to urge the component against the first alignment stops in a first position and release the component in a second position.

15. The bonding apparatus of claim 12, the pressure plate further comprising first and second arms arranged with a longest dimension of the first arm being perpendicular to a longest dimension of the second arm, the first arm having first and second features to engage first and second guides and the second arm having means for engaging the resilient structure.

16. The bonding apparatus of claim 12, further comprising the first and second finger members adjustably attached to the base plate to allow movement along an axis toward and away from first and second alignment pins, the first and second finger members being positioned so that the component can be placed on the supporting surface when the first and second finger members are moved away from first and second alignment pins and so that the component will be urged against first and second alignment pins when the first and second finger members are moved toward the first and second alignment pins.

17. The bonding apparatus of claim 16 the first finger member further comprising two plates in slidable contact with central slots through which a releasable fastening member attaches the two plates to the base plate, the two plates each having a tip which engages the component.

18. A method of fabricating heads for a tape storage device comprising the steps of:

applying an adhesive to a surface of a subcomponent containing a plurality of tape heads or to a surface of a closure piece;

placing the subcomponent and the closure piece together in mating position to form a component;

placing the component on a supporting surface on a base plate of a clamping device, adjusting first and second finger members to urge the component against first and second stop members which extend perpendicularly above the supporting surface;

placing a pressure plate on the component to urge the component against the supporting surface, pressure plate being resiliently attached to a retaining assembly which attaches to the base plate; and curing the adhesive.

19. The method of claim 18 wherein the step of placing a pressure plate on the component further comprises, pushing pins attached to the retaining assembly into friction fit mating holes in the base plate.

20. The method of claim 18 wherein the curing step comprising applying heat.

* * * * *